US006287220B1

(12) United States Patent
Caruso

(10) Patent No.: US 6,287,220 B1
(45) Date of Patent: Sep. 11, 2001

(54) SOCCER PRACTICE RETURN NET

(76) Inventor: Anthony Caruso, Kwik Goal Ltd., 140 Pacific Dr., Quakertown, PA (US) 18951

( * ) Notice: Subject to any disclaimer, the term of this patent is extended or adjusted under 35 U.S.C. 154(b) by 0 days.

(21) Appl. No.: 09/285,964

(22) Filed: Apr. 5, 1999

(51) Int. Cl.[7] ..... A63B 67/00
(52) U.S. Cl. ..... 473/415; 473/469
(58) Field of Search ..... 473/415, 469, 473/467, 492, 493, 494

(56) References Cited

U.S. PATENT DOCUMENTS

| | | | | |
|---|---|---|---|---|
| 2,812,945 | * | 11/1957 | Barreca | 473/492 |
| 4,083,561 | | 4/1978 | Daffer, Jr. . | |
| 5,048,844 | | 9/1991 | Haseltine . | |
| 5,058,899 | * | 10/1991 | Jackson et al. | 473/469 |
| 5,269,533 | | 12/1993 | Kellams . | |
| 5,308,083 | | 5/1994 | Grunfeld et al. . | |
| 5,326,109 | * | 7/1994 | Robl | 473/492 |
| 5,333,880 | * | 8/1994 | Allbright | 473/493 |
| 5,348,309 | * | 9/1994 | Queiros | 473/467 |
| 5,407,178 | * | 4/1995 | Long | 256/45 |
| 5,615,889 | | 4/1997 | Long . | |

* cited by examiner

*Primary Examiner*—Jeanette Chapman
*Assistant Examiner*—M. Chambers
(74) *Attorney, Agent, or Firm*—Richard L. Miller

(57) ABSTRACT

A device for rebounding a soccer ball kicked thereupon and for hugging the ground to prevent the soccer ball from rolling thereunder. The device includes a pair of uprights that extend vertically upwardly from the ground, a net that extends across the pair of upright, and a pair of guy ropes that extend from the pair of uprights and engage the ground. The net has a lower lateral edge that hugs the ground to prevent the soccer ball from rolling thereunder and a pair of longitudinal ends that replaceably engage, respectively, the pair of uprights. Each upright has a throughbore. Each longitudinal end of the net is formed into a sleeve that replaceably and slidingly receives an associated upright. Each sleeve has a throughbore that is aligned with the throughbore in the associated upright, which allows an associated rope to pass therethrough and engage in the throughbore in the associated upright, with a substantial midpoint of the associated rope disposed in the associated upright and with the associated rope wrapped around an outer half of the associated upright and maintained thereat by a knot.

3 Claims, 2 Drawing Sheets

FIG.1
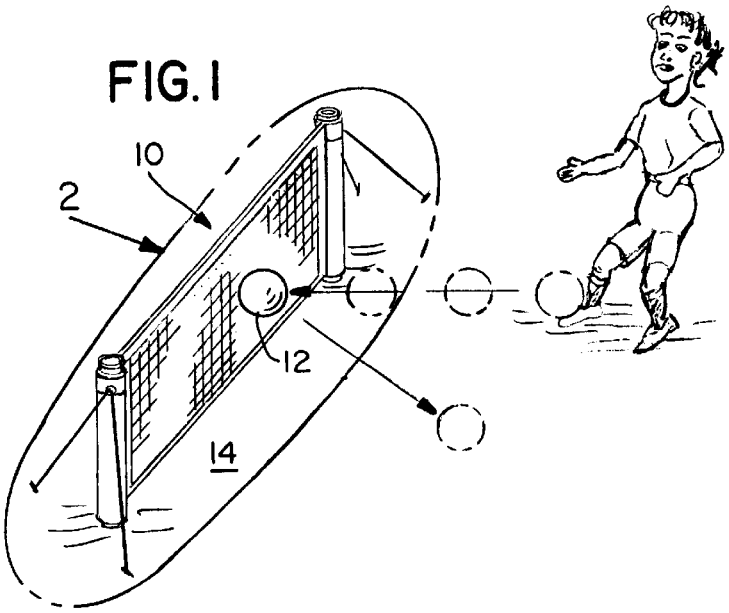
FIG.4
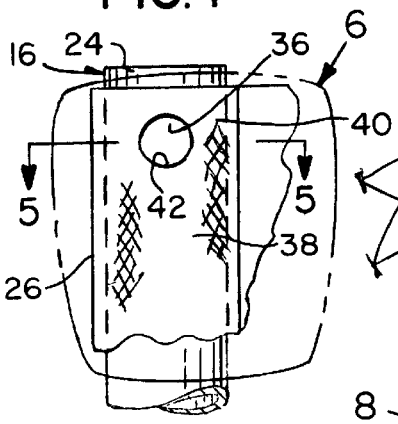
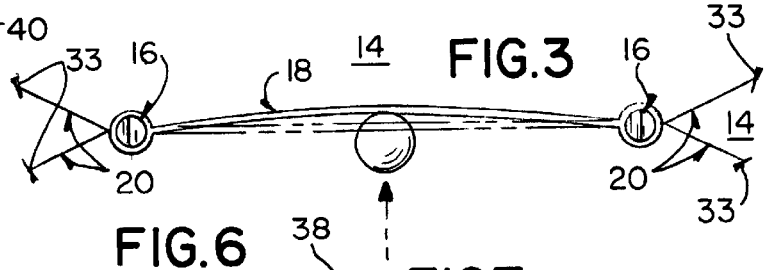
FIG.3
FIG.6
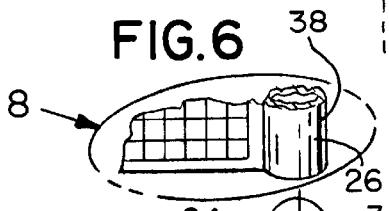
FIG.7
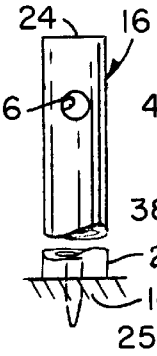
FIG.8
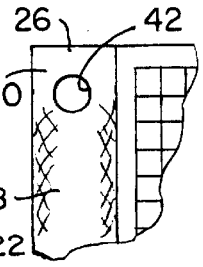
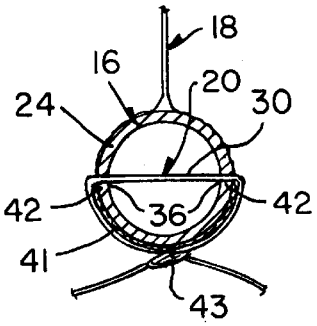
FIG.5
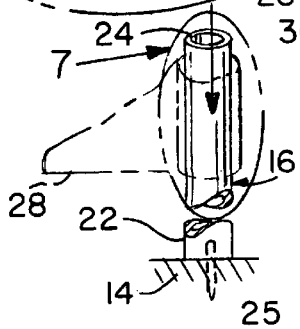

SOCCER PRACTICE RETURN NET

BACKGROUND OF THE INVENTION

1. Field of the Invention

The present invention relates to a device for rebounding a soccer ball kicked thereupon. More particularly, the present invention relates to a device for rebounding a soccer ball kicked thereupon and for hugging the ground to prevent the soccer ball from rolling thereunder.

2. Description of the Prior Art

Numerous innovations for sport net related devices have been provided in the prior art that will be described. Even though these innovations may be suitable for the specific individual purposes to which they address, however, they differ from the present invention.

A FIRST EXAMPLE, U.S. Pat. No. 4,083,561 to Daffer, Jr. teaches a soccer practice net and goal structure which is particularly useful in the training of players for the game of soccer. This soccer practice net can be used as a goal structure for games between teams on a large playing area or readily converted to a ball-returning practice net for use in a limited playing area such as a residential backyard by one or more players.

A SECOND EXAMPLE, U.S. Pat. No. 5,048,844 to Haseltine teaches a soccer goal practice device having a frame and a net extending within the frame. The frame has first and second upstanding side members and a cross member extending between, and connected to the top ends of, the side members. The net is formed as a lattice having a perimeter corresponding substantially in shape and size to the frame. The net includes a rugged perimeter cord along the perimeter of the net, and the perimeter cord has a length shorter than that of the perimeter of the net. The perimeter cord is fastened to the frame such that the net extends between the side members and the cross member. Due to the reduced perimeter of the perimeter cord, the net will include a slight blouse when extending over the frame. The blouse causes ground balls entering the net to be rebounded with an upward velocity component, such that rebounded ground balls bounce. This provides a more challenging and realistic return of the ball to the user. The frame is modular such that the entire device may be easily assembled, disassembled and transported.

A THIRD EXAMPLE, U.S. Pat. No. 5,269,533 to Kellams teaches a support stand for a volleyball net comprising five separable components including a two-part, tubular pole section a three-part, tubular base. The base comprises a tubular T-joint having two 45 degree elbows in a common plane with the T-joint, and a right angle elbow extending out from the intermediate, right angle opening of the T-joint. Removable leg sections fit into the outer ends of the 45 degree elbows to orient the base so that the outer end of the right angle elbow opens vertically upward to receive the lower end of the two-part tubular pole section. The support stand is held in place by the volleyball net and a pair of guy lines which attach to the top of the pole section and are anchored to the ground.

A FOURTH EXAMPLE, U.S. Pat. No. 5,308,083 to Grunfeld et al. teaches a portable soccer goal with rebounding net to return a ball struck into the net. The frame of the goal is formed by a pair of vertical posts and a long horizontal tube and is secured to the ground by a pair of base supports. Pivotable struts further support the vertical posts. The net has a sleeve that positively joins the net to the frame over the entire horizontal length of the frame, and there is a resilient mainstay cord threaded into the net near the periphery. The net and mainstay cord are secured by hooks at the base supports, and the net is oriented to the outside of the struts. When the struts are spread outwards, the tension in the net is increased so as to be sufficient to rebound a ball struck into the net.

A FIFTH EXAMPLE, U.S. Pat. No. 5,615,889 to Long teaches a portable and lightweight soccer practice net that can be quickly attached to and removed from an existing soccer goal frame by one person. The net consists of a generally nonelastic material with webbing straps attached to its perimeter to strengthen the edges of the net. By adjusting the tension in the webbing straps, the tension of the net may be varied to allow different soccer drills to be practiced. The practice net is capable of withstanding high tension forces in excess of 350 pounds to rebound soccer balls at nearly the same speed with which they strike the practice net.

It is apparent that numerous innovations for sport net related devices have been provided in the prior art that are adapted to be used. Furthermore,. even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a device for rebounding a soccer ball kicked thereupon and for hugging the ground to prevent the soccer ball from rolling thereunder that avoids the disadvantages of the prior art.

ANOTHER OBJECT of the present invention is to provide a device for rebounding a soccer ball kicked thereupon and for hugging the ground to prevent the soccer ball from rolling thereunder that is simple and inexpensive to manufacture.

STILL ANOTHER OBJECT of the present invention is to provide a device for rebounding a soccer ball kicked thereupon and for hugging the ground to prevent the soccer ball from rolling thereunder that is simple to use.

BRIEFLY STATED, YET ANOTHER OBJECT of the present invention is to provide a device for rebounding a soccer ball kicked thereupon and for hugging the ground to prevent the soccer ball from rolling thereunder. The device includes a pair of uprights that extend vertically upwardly from the ground, a net that extends across the pair of upright, and a pair of guy ropes that extend from the pair of uprights and engage the ground. The net has a lower lateral edge that hugs the ground to prevent the soccer ball from rolling thereunder and a pair of longitudinal ends that replaceably engage, respectively, the pair of uprights. Each upright has a throughbore. Each longitudinal end of the net is formed into a sleeve that replaceably and slidingly receives an associated upright. Each sleeve has a throughbore that is aligned with the throughbore in the associated upright, which allows an associated rope to pass therethrough and engage in the throughbore in the associated upright, with a substantial midpoint of the associated rope disposed in the associated upright and with the associated rope wrapped around an outer half of the associated upright and maintained thereat by a knot.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention in use;

FIG. 3 is a diagrammatic top plan view taken generally in the direction of arrow 3 in FIG. 2;

FIG. 4 is an enlarged diagrammatic front elevational view of the area generally enclosed by the dotted curve identified by arrow 4 in FIG. 2;

FIG. 5 is diagrammatic cross sectional view taken on line 5—5 in FIG. 4;

FIG. 6 is an exploded diagrammatic perspective view of the area generally enclosed by the dotted curve identified by arrow 6 in FIG. 4;

FIG. 7 is an enlarged diagrammatic front elevational view of the area generally enclosed by the dotted curve identified by arrow 7 of FIG. 6 of an upright of the present invention;

FIG. 8 is an enlarged diagrammatic front elevational view of the area generally enclosed by the dotted curve identified by arrow 8 of FIG. 6 of a net of the present invention.

LIST OF REFERENCE NUMERALS UTILIZED IN THE DRAWING

Figure 2:
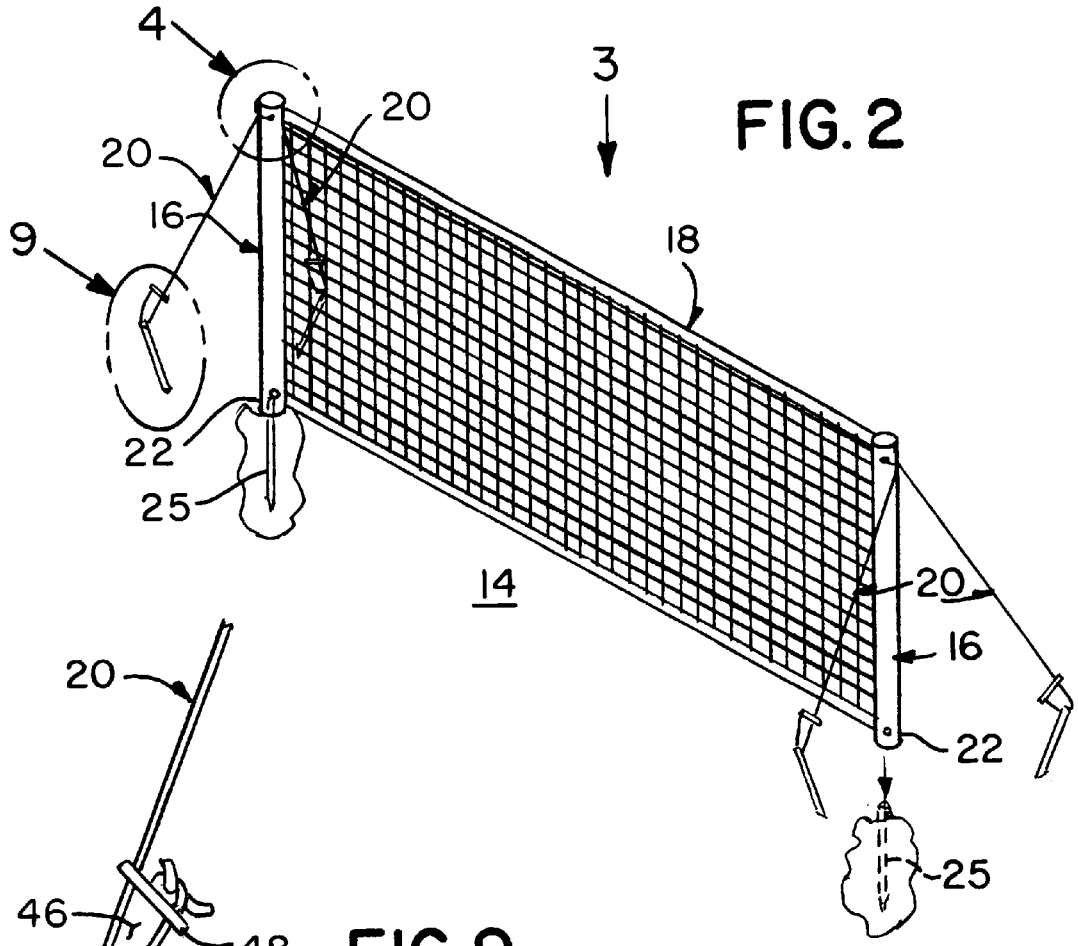
FIG. 2 is an enlarged diagrammatic front elevational view of the area generally enclosed by the dotted curve identified by arrow 2 in FIG. 1 of the present invention.
Figure 9:
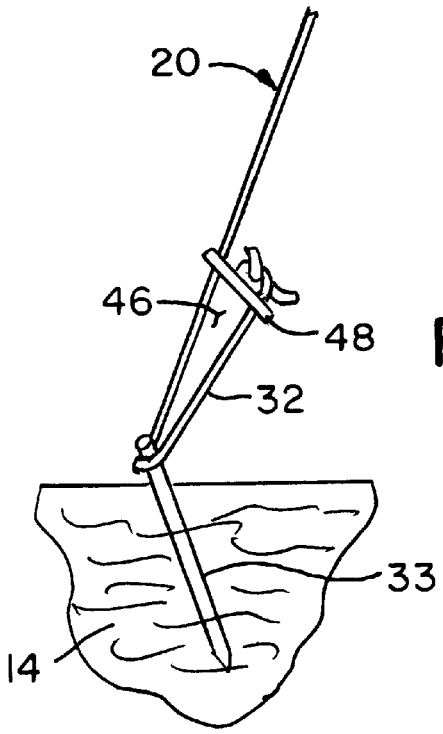
FIG. 9 is a diagrammatic front elevational view of the area generally enclosed in the dotted curve identified by arrow 9 in FIG. 2.

10 device for rebounding a soccer ball kicked thereupon and for hugging the ground to prevent the soccer ball from rolling thereunder of the present invention
12 soccer ball
14 ground
16 pair of uprights for extending vertically upwardly from ground 14
18 net
20 pair of guy ropes for engaging ground 14
22 lower end of each upright of pair of uprights 16 for engaging ground 14
24 upper end of each upright of pair of uprights 16
25 anchor peg depending from lower end 22 of each upright of pair of uprights 16
26 pair of longitudinal ends of net 18
30 substantial midpoint of each rope of pair of guy ropes 20
32 lower ends of each rope of pair of guy ropes 20 for engaging ground 14
33 anchor pegs of pair of guy ropes 20.
36 throughbore in upper end 24 of each upright of pair of uprights 16
38 sleeve formed by each longitudinal end of pair of longitudinal ends 26 of net 18
40 upper end of sleeve 38 of net 18
41 outer half of each upright of plurality of uprights 16
42 throughbore in upper end 40 of sleeve 38 of net 18
43 knot at substantial midpoint 30 of each rope of plurality of guy ropes 20
46 loops formed by lower ends 32 of pair of guy ropes 20
48 tension bars

DETAILED DESCRIPTION OF THE PREFERRED EMBODIMENT

Referring now to the figures, in which like numerals indicate like part, and particularly to FIG. 1, the device for rebounding a soccer ball kicked thereupon and for hugging the ground to prevent the soccer ball from rolling thereunder of the present invention is shown generally at 10 for rebounding a soccer ball 12 kicked thereupon and for hugging the ground 14 to prevent the soccer ball 12 from rolling thereunder.

The general configuration of the device for rebounding a soccer ball kicked thereupon and for hugging the ground to prevent the soccer ball from rolling thereunder 10 can best be seen in FIGS. 2 and 3, and as such, will be discussed with reference thereto.

The device for rebounding a soccer ball kicked thereupon and for hugging the ground to prevent the soccer ball from rolling thereunder 10 comprises a pair of uprights 16 being horizontally spaced-apart for extending vertically upwardly from the ground 14.

The device for rebounding a soccer ball kicked thereupon and for hugging the ground to prevent the soccer ball from rolling thereunder 10 further comprises a net 18 extending replaceably across the pair of uprights 16.

The device for rebounding a soccer ball kicked thereupon and for hugging the ground to prevent the soccer ball from rolling thereunder 10 further comprises a pair of guy ropes 20 extending from the pair of uprights 16 for engaging the ground 14.

The specific configuration of the pair of uprights 16, the net 18, and the pair of guy ropes 20 can best be seen in FIGS. 4–9, and as such, will be discussed with reference thereto.

Each upright of the pair of uprights 16 is tubular and has a height, a lower end 22 for engaging the ground 14, and an upper end 24 that is free.

The lower end 22 of each upright of the pair of uprights 16 has an anchor peg 25 depending longitudinally therefrom for anchoring an associated upright of the pair of uprights 16 in the ground 14.

The net 18 is generally rectangular-shaped and has a lower lateral edge 28 for hugging the ground 14 for preventing the soccer ball 12 from rolling thereunder, a pair of longitudinal ends 26 that replaceably engage, respectively, the pair of uprights 16, with the net 18 taut therebetween experiencing a tension that together with the net 18 being of a resilient material allows the soccer ball 12 kicked thereupon to rebound therefrom, and a height substantially equivalent to the height of each upright of the pair of uprights 16.

Each rope of the pair of guy ropes 20 has a substantial midpoint 30 that releasably engages the upper end 24 of an associated upright of the pair of uprights 16 and lower ends 32 for engaging the ground 14 with anchor pegs 33, with the pair of guy ropes 20 exerting a pulling force counteracting the tension of the net 18 to maintain the pair of uprights 16 vertical.

The upper end 24 of each upright of the pair of uprights 16 has a throughbore 36 that is releasably engaged by the substantial midpoint 30 of an associated rope 30 of the pair of guy ropes 20.

Each longitudinal end of the pair of longitudinal ends 26 of the net 18 is formed into a sleeve 38 that replaceably and slidingly receives an associated upright of the pair of uprights 16, and has an upper end 40.

The upper end 40 of the sleeve 38 of each longitudinal end of the pair of longitudinal ends 26 of the net 18 has a throughbore 42 that is aligned with the throughbore 36 in the upper end 24 of an associated upright of the pair of uprights 16, which allows an associated rope of the pair of guy ropes 20 to pass therethrough and engage in the throughbore 36 in the upper end 24 of the associated upright of the pair of uprights 16, with the substantial midpoint 30 of the associated rope of the pair of guy ropes 20 disposed in the associated upright of the pair of uprights and with the associated rope of the pair of guy ropes 20 wrapped around an outer half 41 of the associated upright of the pair of uprights 16 and maintained thereat by a knot 43.

The lower ends 32 of each guy rope of the pair of guy ropes 20 are formed into loops 46 that receive the anchor pegs 33 for engaging the ground 14, with the loops 46 being formed by tension bars 48.

It will be understood that each of the elements described above, or two or more together, may also find a useful application in other types of constructions differing from the types described above.

While the invention has been illustrated and described as embodied in a device for rebounding a soccer ball kicked thereupon and for hugging the ground to prevent the soccer ball from rolling thereunder, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device for rebounding a soccer ball kicked thereupon and for hugging the ground to prevent the soccer ball from rolling thereunder, said device comprising:

a) a pair of uprights being horizontally spaced-apart for extending vertically upwardly from the ground; each upright of said pair of uprights being tubular and having:

i) a height;

ii) a lower end for engaging the ground; and iii) an upper end being free;

b) a net extending replaceably across said pair of uprights; said net being generally rectangular-shaped and having:

i) a lower lateral edge for hugging the ground for preventing the soccer ball from rolling thereunder;

ii) a pair of longitudinal ends replaceably engaging, respectively, said pair of uprights, with said net taut therebetween experiencing a tension that together with said net being of a resilient material allowing the soccer ball kicked thereupon to rebound therefrom; each longitudinal end of said pair of longitudinal ends of said net formed into a sleeve being replaceably and slidingly receiving an associated upright of said pair of uprights, and having an upper end; and iii) a height substantially equivalent to said height of each upright of said pair of uprights; and c) a pair of guy ropes extending from said pair of uprights for engaging the ground; each rope of said pair of guy ropes having:

i) a substantial midpoint releasably engaging said upper end of an associated upright of said pair of uprights; said upper end of each upright of said pair of uprights having a throughbore releasably engaged by said substantial midpoint of an associated guy rope of said pair of guy ropes; said upper end of said sleeve of each longitudinal end of said pair of longitudinal ends of said net having a throughbore being aligned with said throughbore in said upper end of an associated upright of said pair of uprights, which allows said substantial midpoint of an associated rope of said pair of guy ropes to pass therethrough and engage in said throughbore in said upper end of said associated upright of said pair of upright, with said substantial midpoint of said associated rope of said pair of guy ropes disposed in said associated upright of said pair of uprights and with said associated rope of said pair of guy ropes wrapped around an outer half of said associated upright of said pair of uprights and maintained thereat by a knot; and ii) lower ends for engaging the ground with anchor pegs, with said pair of guy ropes exerting a pulling force counteracting tension in said net to maintain said pair of uprights vertical.

2. The device as defined in claim 1, wherein said lower end of each upright of said pair of uprights has an anchor peg depending longitudinally therefrom for anchoring an associated upright of said pair of uprights in the ground.

3. The device as defined in claim 1, wherein said lower ends of each guy rope of said pair of guy ropes are formed into loops that receive said anchor pegs for engaging the ground, with said loops being formed by tension bars.

* * * * *